United States Patent [19]

Kobayashi et al.

[11] 4,412,562

[45] Nov. 1, 1983

[54] APPARATUS FOR FORMING SELVAGES IN WEAVING MACHINES

[75] Inventors: Takeshi Kobayashi, Aichi; Hajime Suzuki, Anjo, both of Japan

[73] Assignee: Kabushiki Kaisha Toyoda Jidoshokki, Kariya, Japan

[21] Appl. No.: 311,255

[22] Filed: Oct. 14, 1981

[30] Foreign Application Priority Data

Oct. 15, 1980 [JP] Japan ..... 55-143842

[51] Int. Cl.[3] ..... D03C 11/00; D03D 47/40

[52] U.S. Cl. ..... 139/54; 139/352; 139/353

[58] Field of Search ..... 139/54, 336, 349, 353, 139/337, 352

[56] References Cited

U.S. PATENT DOCUMENTS

| | | | |
|---|---|---|---|
| 3,360,011 | 12/1967 | Fluhmann | 139/54 |
| 4,166,480 | 9/1979 | Muller | 139/54 |
| 4,248,272 | 2/1981 | Wilson et al. | 139/353 |
| 4,300,599 | 11/1981 | Wueger | 139/353 |

*Primary Examiner*—Henry Jaudon

*Attorney, Agent, or Firm*—Brooks, Haidt, Haffner & Delahunty

[57] ABSTRACT

A selvage apparatus including a photo-cell type device for detecting abnormal conditions of selvage threads is disclosed. In the detecting device comprising a microprocessor, the number of light interruptions by the selvage threads is counted and compared with a reference number, whereby abnormal conditions are detected on the basis of whether or not the number of light interruptions is less than the reference number.

4 Claims, 6 Drawing Figures

APPARATUS FOR FORMING SELVAGES IN WEAVING MACHINES

BACKGROUND OF THE INVENTION

This invention generally relates to apparatus for forming selvages in weaving machines or looms and more particularly to the detection of unfavourable conditions relating to the selvage threads in the selvage forming apparatus.

Particularly in shuttleless looms, after each picking motion, the weft thread is cut near the ends of the woven cloth and therefore the cut ends of the weft thread are apt to enter the inside of the cloth if they shrink. More specifically, some warp threads near the cloth ends will become loose even when only a slight force is externally applied thereto. This is also applicable to a wide cloth which is cut at the center during the weaving. To remove the above-discussed disadvantages, a selvage forming apparatus is generally disposed near the endmost ground warp thread forming the cloth so that a selvage is provided to the cloth by causing the weft threads to be caught by selvage threads. In general, such a selvage forming apparatus is of the type including a shed forming member with selvage thread guide eyelets, through which two selvage threads are guided. Upon rotation of the shed forming member, the two selvage threads make downward and upward movements to form therebetween a shed into which the weft thread is inserted. The inserted weft thread is intertwined with the selvage threads during the next downward and upward movements thereof, thus forming the selvage.

As can be understood, to some extent a tension is always applied to each selvage thread passing through the shed forming member to the fell of the cloth, and the machine operator may encounter abnormal conditions, such as excessively decreased tension and breakage of the selvage thread. To detect such abnormal conditions, various devices have been heretofore provided. For example, each of Japanese Laid-Open U.M. Specification No. 53-90667 and U.S. Pat. No. 4,166,480 shows an abnormal condition detecting device of the type including a pivotable arm disposed in the immediate vicinity of a selvage thread bobbin and supporting a portion of the selvage thread at its free end to detect the tension of the selvage thread. In this type of detecting device, the free end of the arm is adapted to turn a small amount upon the occurrence of a change in the tension of the selvage thread and when the arm turns a large amount due to breakage of the selvage thread, the free end thereof approaches a proximity switch to thereby turn on the same, thus detecting the abnormal condition of the selvage thread.

However, such a detecting device is not only a complex mechanism necessarily including, in addition to the pivotably supported arm, a spring for biasing the arm into an operative, i.e., abnormal condition detecting, position against the tension of the selvage thread, said proximity switch operative in response to the turning of the arm, but also requires a sufficient space near the selvage thread bobbin to contain these elements. Furthermore, since this detecting device employs a proximity switch, in order to assure the turning on of the proximity switch when an abnormal condition occurs the operating element attached to the free end of the arm and operatively associated with the proximity switch must always be moved into a fixed position with respect to the stationary proximity switch. However, it is very difficult for manufacturing reasons to mount the arm and the proximity switch so that the said operating element can always be moved to the fixed position.

It is therefore a principal object of this invention to provide a device for detecting abnormal conditions of selvage threads which is simple in its construction and installation, does not require a large mounting space, and carries out certain detection of the abnormal conditions of the selvage threads.

SUMMARY OF THE INVENTION

With the above object in view, this invention resides in an apparatus for forming a selvage in a weaving machine comprising a movable shed forming member having selvage thread guide eyelets through which selvage threads pass to provide each of the selvage threads with upward and downward movements when said shed forming member moves thereby allowing the selvage threads to catch a weft thread, and a device for detecting abnormal conditions of the selvage threads disposed between said shed forming member and the fell of the cloth and within the range of the upward and downward movements of the selvage threads, said detecting device comprising photocell means for producing a light beam and detecting an interruption of the light beam by the selvage threads upon their upward and downward movements, means for counting the number of light interruptions, and means for comparing the counted number with a predetermined number to thereby determine whether or not an abnormal condition of the selvage threads is occurring.

BRIEF DESCRIPTION OF THE DRAWINGS

This invention will become more readily apparent from the following description of a preferred embodiment thereof, also shown, by way of example only, in the accompanying drawings, in which.

DESCRIPTION OF THE PREFERRED EMBODIMENT

Figure 1:
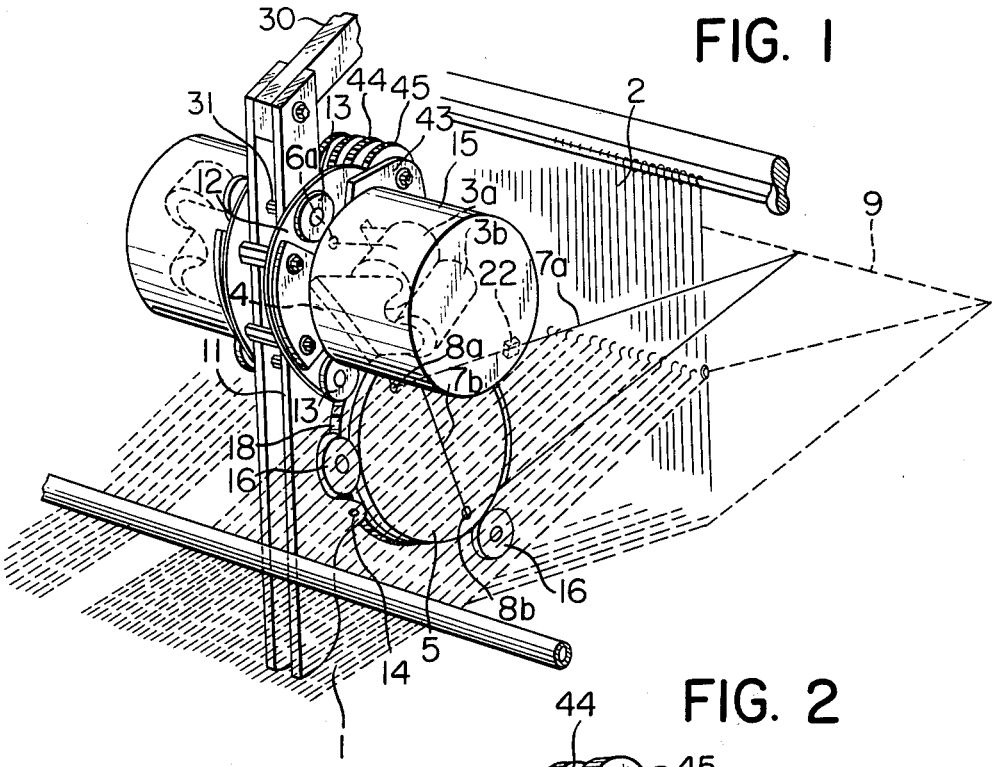
FIG. 1 is a perspective view showing the selvage forming apparatus incorporating a detecting device of this invention therein.

Referring to FIG. 1, there is shown a center selvage apparatus disposed at the center of a cloth width, in which apparatus this invention is embodied. Although the center selvage apparatus includes two selvage forming units so as to form the selvages on the opposite sides of the center selvage apparatus, reference numerals are added to only one of the two selvage forming units for simplicity of illustration.

Figure 2:
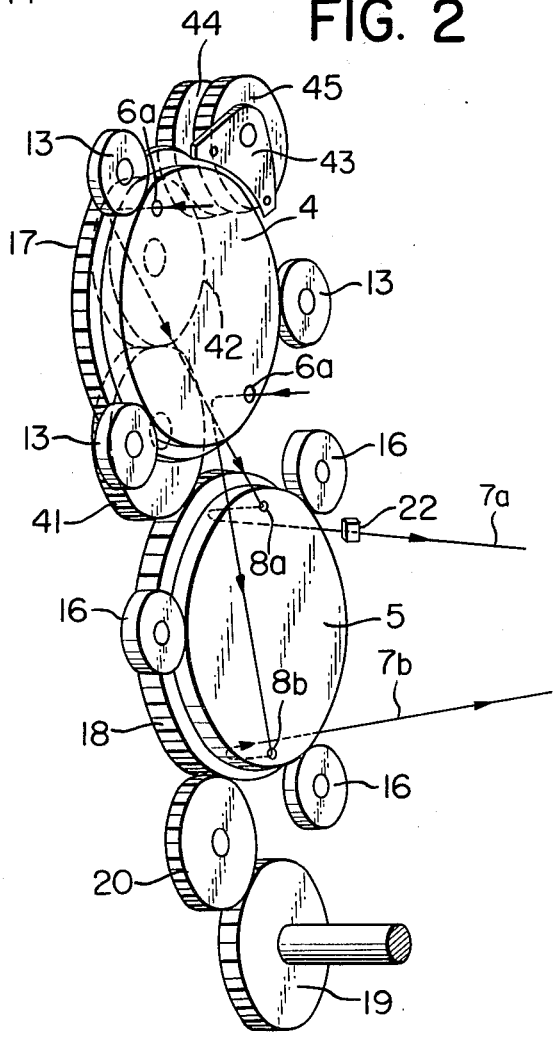
FIG. 2 is a perspective view showing a mechanism for driving the selvage forming apparatus of FIG. 1.

In FIGS. 1 and 2, a pair of vertically extending, spaced support plates 11 are fixedly attached through a bracket 30 to a weaving machine frame (not shown) and have annular thin plates 12 connected at the relatively upper portions thereof by means of nut and bolt assemblies 31, which also rotatably support three rollers 13 circumferentially disposed at the same intervals on the outer side of each thin plate 12. Also, the support plates 12 have similar annular thin plates (not shown) directly connected at the relatively lower portions thereof by suitable connecting means 14. On this lower thin plate, three rollers 16 are similarly mounted for rotation in an equi-spaced relationship. As best shown in FIG. 2, the upper roller set supports a rotary disk 4 carrying selvage thread bobbins 3*a* and 3*b*, and the lower roller set supports a shed forming member or rotary disk 5 adapted to rotate synchronously with disk 4. The selvage thread bobbins 3*a* and 3*b* are housed in a generally cylindrical housing 15.

Gears 17 and 18 are integral with the rotary disks 4 and 5 respectively, and operatively associated with a rotation transmission mechanism comprising a drive gear 19 meshing through an intermediate gear 20 with said gear 18 to rotate rotary disk 5, and a gear 41 meshing with gear 18 to transmit the rotation thereof through a gear train (including gears 42, 44 and 45) to gear 17 to thereby rotate rotary disk 4. Gears 44 and 45 formed into a single unit are supported by a bracket 43 attached to the annular thin plate 12 (FIG. 1). Thus, the rotary disks 4 and 5 can rotate in the same direction and at the same speed.

With respect to these rotary disks 4 and 5, upper and lower selvage threads 7*a* and 7*b* supplied from the bobbins 3*a* and 3*b* enter selvage thread guide eyelets 6*a* and 6*b* provided in disk 4 and then pass through a space between disk 4 and the adjacent support plate 11 into selvage thread guide eyelets 8*a* and 8*b* from the front side of rotary disk 5. The selvage threads 7*a* and 7*b* further pass beside the reverse side of rotary disk 5 and reach the cloth fell 9 in the same manner as ground warp threads, forming the cloth. Upon the rotation of rotary disk 5, the selvage threads 7*a* and 7*b* alternately make upward and downward movements, thus forming a shed.

Figure 3:
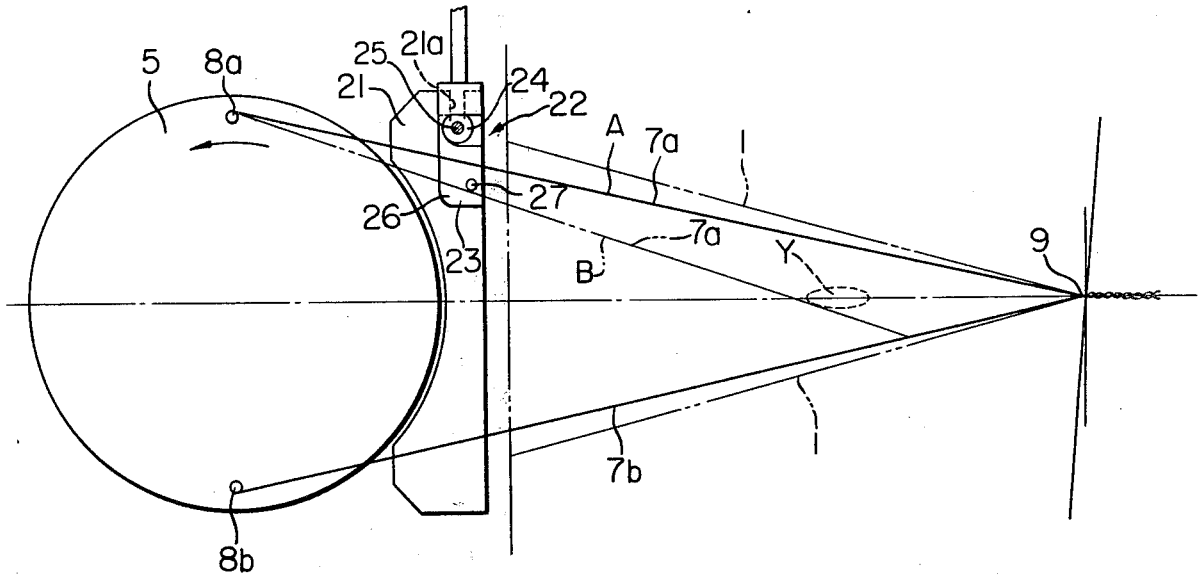
FIG. 3 is an enlarged front elevational view of the essential parts, showing the positional relationship among a shed forming disk, selvage yarns and the detecting device.

During such movements of the selvage threads 7*a* and 7*b*, if abnormal conditions, such as breakage or an excessive decrease in the tension of a selvage thread, occur, for example in selvage thread 7*a*, the portion of selvage thread 7*a* present between the back of rotary disk 5 and the cloth fell 9 will sag into a position B shown by the dot and dash line in FIG. 3. If such a sag occurs in selvage thread 7*a* the selvage will not be formed, since selvage thread 7*a* in the position B is below a path Y, through which a weft thread is to be inserted.

Figure 4:
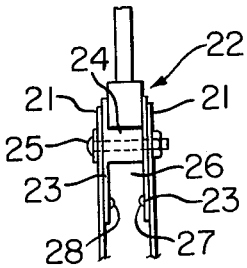
FIG. 4 is a side elevational view of the detecting device.

According to this invention, a device for detecting the sagging of selvage thread 7*a* is disposed on the reed 2 side of rotary disk 5. As shown in FIG. 3, this detecting device is disposed immediately in front of the upper part of rotary disk 5, and as shown in FIG. 4 the detecting device is disposed between the upper portions of vertically extending mounting plates 21 fixedly connected to a portion of the machine frame. The selvage threads 7*a* and 7*b* pass between the paired mounting plates 21.

The detecting device comprises a body 22 disposed between and connected to the mounting plates 21 by a screw and nut assembly 25 as best shown in FIG. 4. The body 22 includes a pair of legs 23 vertically extending along the inner surfaces of the associated mounting plates 21, and a connecting sleeve 24 connecting the legs 23 together at substantially their mid portions by means of said screw and nut assembly 25. Between the legs 23, a space 26 having an open bottom is provided so that the upper selvage thread 7*a* can pass between the legs 23. A pair of oblong slots 21*a* are vertically provided in the upper edges of the paired mounting plates 21 to receive therein the opposite ends of the screw 25 to thereby allow the vertical position of the body 22 to be adjusted with respect to the mounting plates 21.

On the inner sides of the legs 23, there are provided conventional photo-cell means comprising light emitting and receiving elements 27 and 28 to detect the vertical movement of selvage thread 7*a* therebetween. For this purpose, these elements 27 and 28 are positioned at a level between the normal condition path A and the abnormal condition path B of selvage thread 7*a*. It will be understood that in the embodiment illustrated, four selvage threads, two for each of the left and right side disks 5, pass between the light emitting and receiving elements 27 and 28, since this invention is embodied in a center selvage apparatus.

In the detecting device, light interruption signals are produced in a conventional manner whenever the selvage threads 7*a* and 7*b* are moved upwards and downwards across the light beam by the rotation of the shed forming rotary disk 5. However, if the aforementioned abnormal conditions occur in a selvage thread, the selvage thread connected will be allowed to move upwards only to the abnormal condition path B and will not interrupt the light beam travelling between the light emitting and receiving elements 27 and 28. In such a case, a light interruption signal is not produced and the number of light interruption signals per one cycle of the weaving machine, i.e., one complete rotation of the crank shaft, decreases. This decrease is detected as an abnormal indication signal.

The shed forming rotary disk 5 is adapted to rotate by an angle of 180° per one complete rotation of the crank shaft of the weaving machine. Therefore, if disk 5 makes a half rotation starting from the position shown in FIG. 3, each of the upper and lower selvage threads 7*a* and 7*b* makes one passage across the light beam. In the case of a center selvage apparatus, since four selvage threads are present between the mounting plates 21, a number of selvage thread detections less than 4 per each half rotation of the shed forming disk 5 can be recognized as the occurrence of an abnormal condition in the selvage threads 7*a* and 7*b*.

Figure 5:
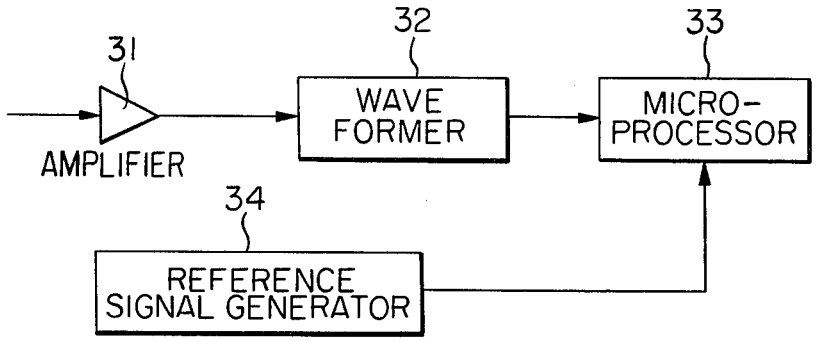
FIG. 5 is a block diagram of the several elements forming the detecting device.

Referring to FIG. 5, there is shown a block diagram of a detecting device comprising an amplifier 31 for amplifying the light interruption signal transmitted thereto from the light emitting and receiving elements 27 and 28, a wave former for shaping the amplified signal in the form of a digit, and a microprocessor 33 to which the digital signal is inputted from the wave former 32. Also, a reference signal generator 34 such as the proximity switch disclosed in the above-mentioned prior art references is associated with the microprocessor 33 to input thereto one reference signal for each half rotation of the shed forming disk 5, i.e. one complete rotation of the crank arm of the weaving machine. Thus, it will be understood that the microprocessor 33 can produce a stop requirement signal causing the stoppage of the weaving machine by comparing the number of light interruption signals with the number of reference signals produced by the rotation of the shed forming disk 5.

Figure 6:
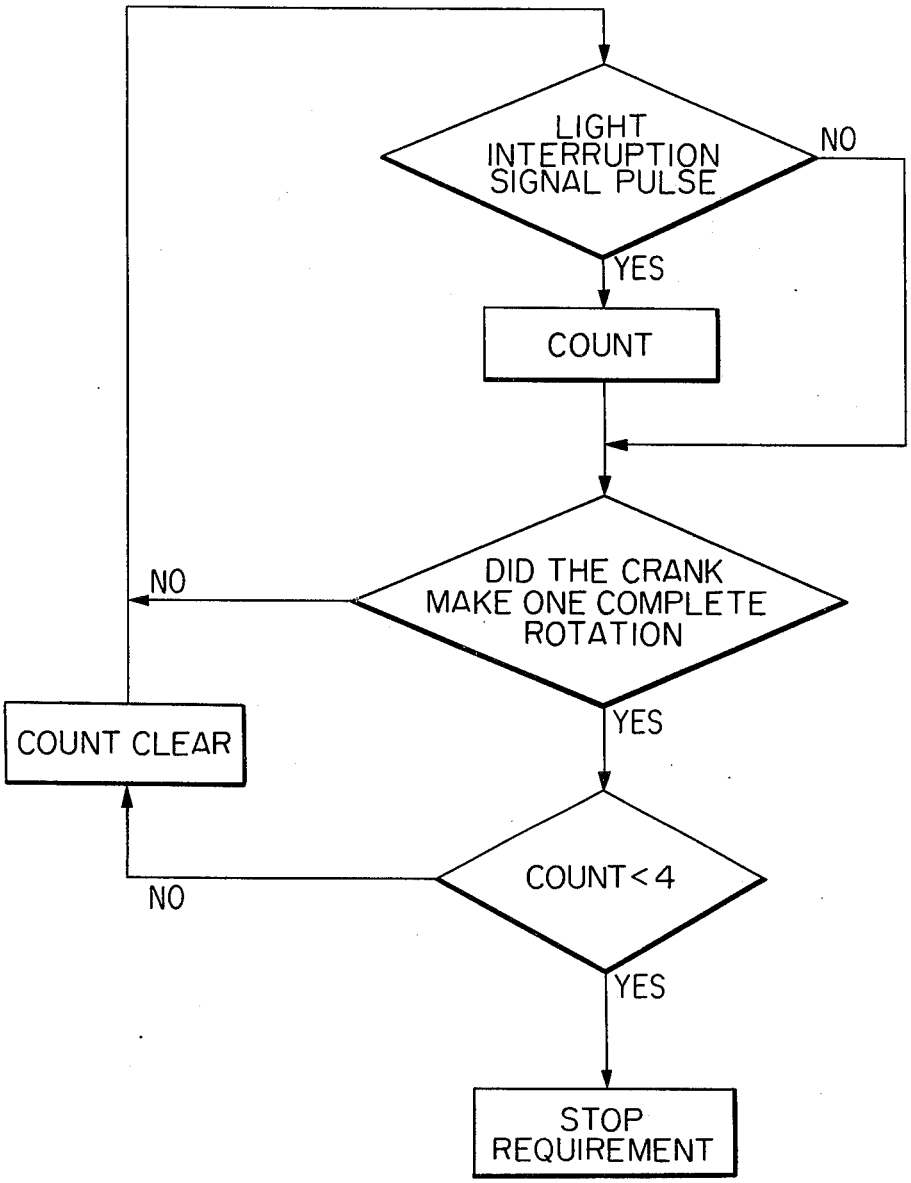
FIG. 6 is a flow chart showing the processing operation in the microprocessor of the detecting device.

The processing operation in the microprocessor 33 will be described below with reference to FIG. 6. The microprocessor 33 counts the number of light interruption signals inputted thereto at the rate of four per reference signal from the reference signal generator 34 during the normal selvage forming operation of the center selvage apparatus. Therefore, in the microprocessor 33, whether or not the crank shaft made a predetermined number (one, in the embodiment) of rotations is confirmed. Then, the count is compared with the number of the reference signals produced during the predetermined number of rotations of the crank shaft to decide whether or not the number of selvage threads is normal.

If the count is below 4, the microprocessor 33 regards the selvage threads as in an abnormal condition and provides a stop requirement signal causing the weaving machine to be stopped in the conventional manner. On the contrary, if the count is equal to 4, it is cleared and the number of light interruption signals is counted again.

In the above-discussed embodiment, although the light emitting and receiving elements 27 and 28 are disposed in the relatively upper positions shown in FIG. 3 so that the detection of an abnormal condition of the selvage threads can be performed when they move down from the normal condition path A to the abnormal condition path B, the positions of the light emitting and receiving elements 27 and 28 are not limited thereto, since the selvage threads when broken may not be allowed to move upwards to the path B shown in FIG. 3. That is, light emitting and receiving elements 27 and 28 can be disposed in positions between the normal condition path A of the upper selvage thread 7*a* and the path of the lower selvage thread 7*b*. Furthermore, the detecting device may be disposed in any position between the reed 2 and the shed forming disk 5.

Although this invention has been described as embodied in a center selvage apparatus, it is apparent that this invention can be equally applied to selvage apparatuses for forming a waste selvage and selvage at the opposite ends of a cloth. Furthermore, although the embodiment has employed a rotary disk as a shed forming member, vertically reciprocating levers each having a selvage thread guiding eyelet such as shown in U.S. Pat. No. 3,242,949 or other means may be employed in lieu of the shed forming rotary disk.

It is understood from the foregoing that various advantages can be provided according to this invention. For example, since the detecting device is of the photocell type, movable mechanical parts are eliminated, resulting in a simple and compact construction. This permits the space for mounting the detecting device to be minimized and the mounting position to be relatively freely selected, resulting in the easy installation thereof. Furthermore, abnormality in the selvage threads can be detected exactly.

What we claim is:

1. Apparatus for forming a selvage in a weaving machine, comprising a moveable shed forming member having selvage thread guide eyelets through which selvage threads pass to provide each of the selvage threads with upward and downward movements when said shed forming member moves, thereby allowing the selvage threads to catch a weft thread, and a device for detecting abnormal conditions of the selvage threads disposed between said shed forming member and the fell of the cloth and within the range of the upward and downward movements of the selvage threads, said detecting device comprising a pair of legs disposed on opposite sides of said upwardly and downwardly moving selvage threads and photo-cell means comprising light emitting and receiving elements mounted on the inner sides of said legs so as to face each other for producing a light beam and detecting an interruption of the light beam by the selvage threads upon their upward and downward movements, means for counting the number of said light interruptions, and means for comparing the counted number with a predetermined number to thereby decide whether or not an abnormal condition of the selvage threads exists.

2. The apparatus as claimed in claim 1, wherein said detecting device is disposed in the immediate vicinity of said shed forming member and said pair of legs are disposed on the opposite sides of the upper selvage thread.

3. The apparatus as claimed in claim 2, wherein said light emitting and receiving elements are disposed between the normal and abnormal condition paths of the upper selvage thread.

4. The apparatus as claimed in claim 1, wherein said detecting device comprises an amplifier for amplifying light interruption signals transmitted thereto from said light emitting and receiving elements, a wave former for receiving said amplified light interruption signals from said amplifier and for shaping said signals to provide digital signals therefrom, a reference signal generator for producing said predetermined number of signals, and said counting and comparing means comprises a microprocessor for receiving and counting said digital signals and for receiving said predetermined number of signals for comparison with said counted signals.

* * * * *